US009947526B2

(12) United States Patent
Shinoda et al.

(10) Patent No.: US 9,947,526 B2
(45) Date of Patent: Apr. 17, 2018

(54) GAS DISCHARGE DEVICE AND FLAT LIGHT SOURCE USING THE SAME, AND DRIVING METHOD THEREFOR

(71) Applicant: SHIKOH TECH LLC, Awaji-shi, Hyogo (JP)

(72) Inventors: Tsutae Shinoda, Akashi (JP); Hitoshi Hirakawa, Takasago (JP); Kenji Awamoto, Miki (JP); Bingang Guo, Akashi (JP); Takefumi Hidaka, Kobe (JP); Junichiro Takahashi, Nishinomiya (JP)

(73) Assignee: SHIKOH TECH LLC, Awaji (JP)

( * ) Notice: Subject to any disclaimer, the term of this patent is extended or adjusted under 35 U.S.C. 154(b) by 0 days.

(21) Appl. No.: 15/308,802

(22) PCT Filed: Jan. 29, 2016

(86) PCT No.: PCT/JP2016/052716

§ 371 (c)(1),
(2) Date: Nov. 3, 2016

(87) PCT Pub. No.: WO2016/125708

PCT Pub. Date: Aug. 11, 2016

(65) Prior Publication Data

US 2017/0186596 A1 Jun. 29, 2017

(30) Foreign Application Priority Data

Feb. 3, 2015 (JP) ..... 2015-019141
May 14, 2015 (JP) ..... 2015-099146

(51) Int. Cl.
*H01J 1/62* (2006.01)
*H01J 65/00* (2006.01)
(Continued)

(52) U.S. Cl.
CPC ..... *H01J 65/00* (2013.01); *H01J 11/18* (2013.01); *H01J 61/06* (2013.01); *H01J 61/305* (2013.01);
(Continued)

(58) Field of Classification Search
CPC ..... H01J 65/00; H01J 11/18; H01J 61/305; H01J 61/42; H01J 63/08; H05B 41/24
See application file for complete search history.

(56) References Cited

U.S. PATENT DOCUMENTS 5,514,934 A 5/1996 Matsumoto et al.
2006/0043869 A1* 3/2006 Yoon ..... H01J 61/305 313/491
(Continued)

FOREIGN PATENT DOCUMENTS

JP H05-82101 A 4/1993
JP 2002-216704 A 8/2002
(Continued)

OTHER PUBLICATIONS

Japan Patent Office, International Search Report, dated Mar. 15, 2016.

*Primary Examiner* — Tung X Le
*Assistant Examiner* — Raymond R Chai
(74) *Attorney, Agent, or Firm* — Stites & Harbison, PLLC; Jeffrey A. Haeberlin; Rachel D. Rutledge

(57) ABSTRACT

A gas discharge device includes a thin glass tube filled with a discharge gas; a pair of first and second long electrodes extending toward either side along a longitudinal direction with a discharge gap interposed therebetween are provided outside of a back side flat surface of a thin glass tube; and a ultraviolet phosphor layer formed on an inner surface at the back side flat surface, the thin glass tube filled with a discharge gas having a front side flat surface and the back
(Continued)

side flat surface facing each other on a transverse section, wherein, starting with trigger discharge that is initially generated in the discharge gap as a result of a voltage increase when a voltage with a sine waveform or an inclined waveform is applied between both electrodes, the discharge gradually extends so as to move in the longitudinal direction of the electrodes. Ultraviolet light having high luminous efficiency and emission intensity is obtained from a front side surface of the thin glass tube by driving the device with a sine-wave AC voltage.

14 Claims, 8 Drawing Sheets

(51) Int. Cl.

| | |
|---|---|
| ***H01J 11/18*** | (2012.01) |
| ***H01J 63/08*** | (2006.01) |
| ***H01J 61/06*** | (2006.01) |
| ***H01J 61/30*** | (2006.01) |
| ***H01J 61/42*** | (2006.01) |
| ***H05B 41/24*** | (2006.01) |

(52) U.S. Cl.
CPC ..... *H01J 61/42* (2013.01); *H01J 63/08* (2013.01); *H05B 41/24* (2013.01)

(56) References Cited

U.S. PATENT DOCUMENTS

| | | | | |
|---|---|---|---|---|
| 2009/0058295 | A1* | 3/2009 | Auday | H01J 61/04 313/581 |
| 2009/0058299 | A1* | 3/2009 | Oda | H01J 61/125 313/607 |
| 2011/0227501 | A1* | 9/2011 | Awamoto | H01J 65/046 315/287 |
| 2013/0140979 | A1* | 6/2013 | Morita | H01J 17/49 313/487 |
| 2013/0175454 | A1* | 7/2013 | Cooper | C02F 1/325 250/435 |

FOREIGN PATENT DOCUMENTS

| | | | |
|---|---|---|---|
| JP | 2004-170074 | A | 6/2004 |
| JP | 2011-040271 | A | 2/2011 |
| JP | 5074381 | B2 | 11/2012 |
| KR | 20080035647 | A | 4/2008 |

* cited by examiner

GAS DISCHARGE DEVICE AND FLAT LIGHT SOURCE USING THE SAME, AND DRIVING METHOD THEREFOR

TECHNICAL FIELD

The present invention relates to a gas discharge device and a flat light source using the same, and more particularly to an external electrode type discharge tube, which includes a thin glass tube as a main component, for an ultraviolet or visible light source, a flat surface light source using the same, and a driving method therefor.

BACKGROUND ART

There have conventionally been known a high-pressure mercury lamp, an excimer discharge lamp, and the like as a light source device using gas discharge. There has also been known a gas discharge device using an ultraviolet light-emitting phosphor as an ultraviolet light source (for example, see Patent Document 1). Also, an external electrode type gas discharge device having a thin tube configuration suitable for a configuration of a flat light source has been known (for example, see Patent Documents 2, 3, and 4).

PRIOR ART

Patent Document

Patent Document 1: Japanese Patent No. 5074381
Patent Document 2: Japanese Unexamined Patent Publication No. 2004-170074
Patent Document 3: Japanese Unexamined Patent Publication No. 2011-040271
Patent Document 4: Japanese Unexamined Patent Publication No. 2002-216704

SUMMARY OF THE INVENTION

Problem to be Solved by the Invention

A conventional excimer discharge lamp of UV-C band using an ultraviolet phosphor has problems of requiring an expensive quartz glass envelope and requiring a high-voltage rectangular-wave alternating-current power source for drive. Further, a conventional gas discharge device for ultraviolet light emission using a gas discharge tube has a complicated electrode structure, and has not yet been developed to a practical level from a viewpoint of luminous efficiency and emission intensity.

In view of this, the present invention provides an inexpensive gas discharge device for a light source, particularly for an ultraviolet light source, with a simple configuration and excellent luminous efficiency. The present invention also provides a plasma tube type gas discharge device that can easily configure a flat light source for ultraviolet or visible light emission with high luminous efficiency and large emission intensity.

Means for Solving the Problems

The present invention provides a novel external electrode type gas discharge device for a light source generating at least two types of discharges between a pair of long electrodes. Specifically, the present invention is based on an idea in which first and second discharge electrodes extending toward either side along the longitudinal direction of a thin glass tube containing a discharge gas sealed therein are provided with a discharge gap being interposed therebetween, trigger discharge is initially generated between the adjacent ends of the electrodes as a result of a voltage increase when an alternating-current voltage with a sine waveform or an inclined waveform is applied between both electrodes, and the trigger discharge is gradually grown so as to expand in each longitudinal direction of the electrodes. The pair of discharge electrodes is disposed to extend to either side with the discharge gap formed by the adjacent ends being interposed therebetween.

More specifically described, the first aspect of the present invention lies in the configuration of the gas discharge device comprising: a transparent envelope that has a front side and a back side which face each other on a transverse section thereof, the transparent envelope containing a discharge gas sealed therein; and first and second electrodes which are provided outside of the envelope at the back side, the first and second electrodes including: trigger electrode portions that constitute a trigger discharge portion at a position where the trigger electrode portions are adjacent to each other on the outside of the envelope at the back side; and main electrode portions extending in a direction of being away from each other with the trigger discharge portion being interposed therebetween.

It is preferable that a transparent thin glass tube having a circular, oval, flat-oval, rectangular, or trapezoidal transverse section with a major axis of 5 mm or less is used. The length of the thin glass tube is appropriately from 2 cm to 10 cm, and the thin glass tube may be longer than this size according to practical application. Further, even if a thin borosilicate glass tube that is more inexpensive and popular than a quartz tube is used for an envelope composing an ultraviolet light source, sufficient ultraviolet transmission light can be obtained by setting the thickness of the tube at a front side, serving as a light-emitting surface, to be 300 μm or less.

The first and second electrodes extend toward either end with a gap interposed therebetween in the longitudinal direction of the envelope made of the thin glass tube, wherein the adjacent ends thereof at the gap constitute trigger electrode portions and the extended portions thereof at either side constitute main electrode portions.

In this configuration, the first and second electrodes may be provided on a straight line along the longitudinal direction of the envelope composed of the thin glass tube, or on different lines. Further, on an end of one of the first and second electrodes, a trigger electrode member facing an end of the other may be provided. In addition, a plurality of the first and second electrodes may alternately be provided along the longitudinal direction of the thin glass tube.

An ultraviolet phosphor layer, which is excited by vacuum ultraviolet light mainly generated due to xenon gas discharge to emit light, a visible phosphor layer, or a mixed phosphor layer of these phosphors, is provided on the inner surface of the bottom part of the envelope at the back side, whereby emission of light with a desired wavelength can be obtained from the front side of the envelope.

Further, according to the present invention, a flexible flat surface light source can be configured by arraying a plurality of the thin glass tubes on a common electrode of the gas discharge device having the thin tube configuration mentioned above.

Effect of the Invention

According to the gas discharge device of the present invention, high-efficient light emission can be achieved by a simple electrode configuration composed of the first and second electrodes arranged along the longitudinal direction of the envelope. In addition, with the configuration in which an ultraviolet light-emitting phosphor layer is formed in a thin glass tube serving as the envelope, emission of ultraviolet light having UV-B band or UV-C band can be performed with high intensity and high efficiency, compared to a conventional ultraviolet LED or the like.

Further, a film-type flat light source can easily be configured by arraying a plurality of ultraviolet light-emitting tubes on a common electrode sheet. Therefore, industrial practical use, such as medial application or sterilization application, is significantly expanded.

EMBODIMENTS OF THE INVENTION

Figure 1:
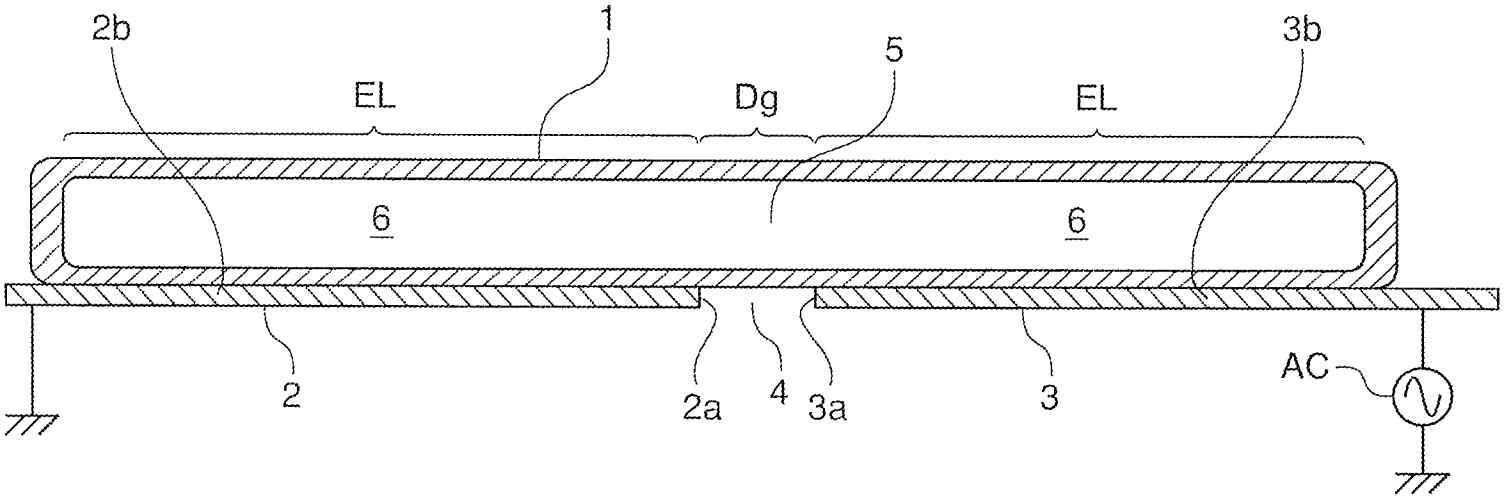
FIG. 1 is a longitudinal sectional view schematically showing the configuration of a gas discharge device according to a first embodiment of the present invention.
Figure 2A:
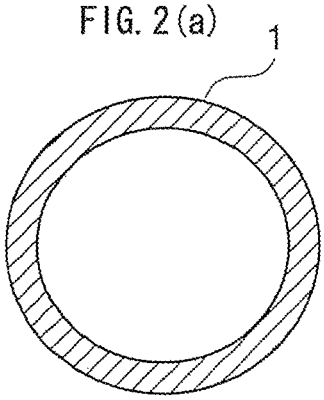
FIG. 2 is a transverse sectional view showing an example of a shape of a glass envelope mainly composing the gas discharge device.
Figure 2B:
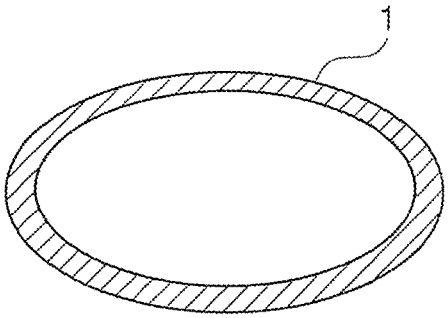
Figure 2C:
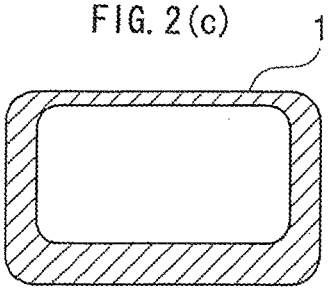
Figure 2D:
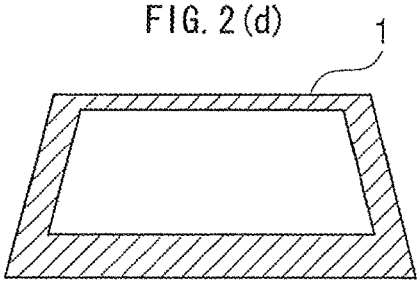
Figure 3A:
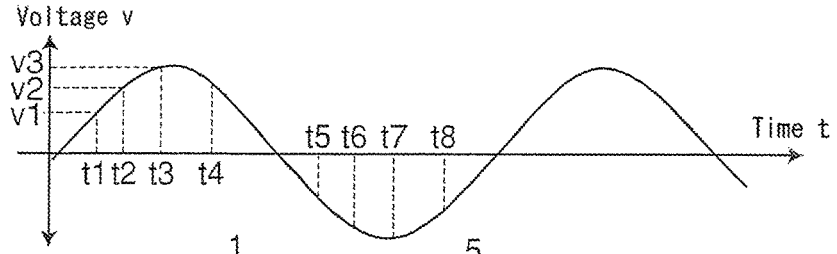
FIG. 3 is an explanatory view showing a discharge model in the gas discharge device according to the present invention.
Figure 3B:
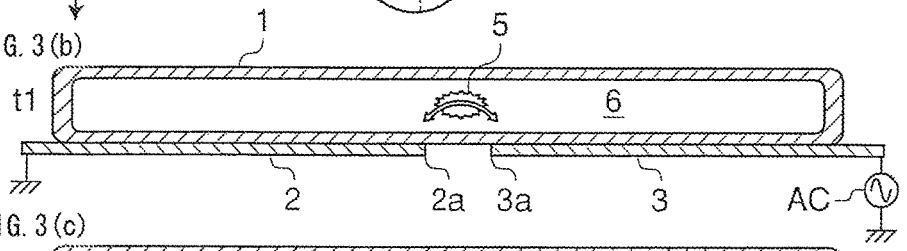
Figure 3C:
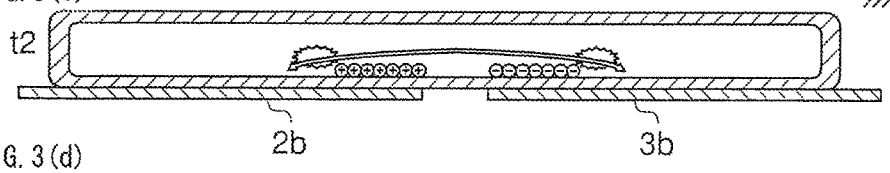
Figure 3D:
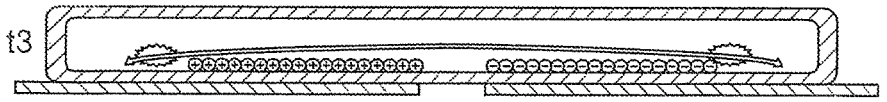
Figure 3E:
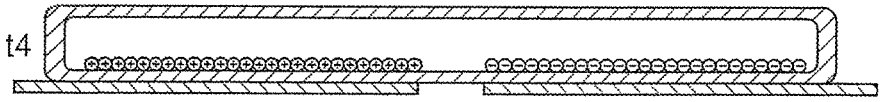
Figure 3F:
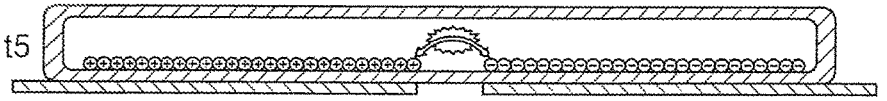
Figure 3G:
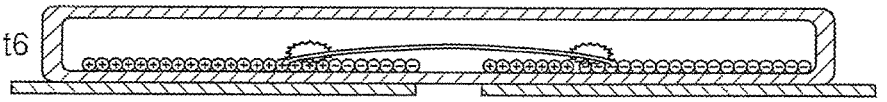
Figure 3H:
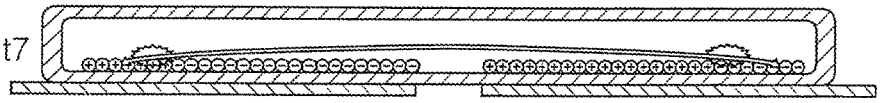
Figure 3I:
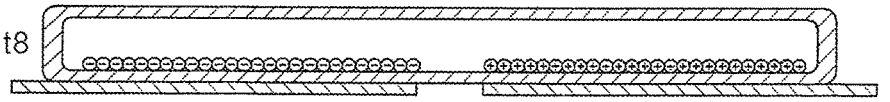

Preferable embodiments of the present invention will be described below in detail with reference to the drawings. It is to be noted that, for simplifying the description, the same components are identified by the same reference numerals. Further, in the description below, an electrode extending in a longitudinal direction of a glass tube is referred to as a "long electrode" for characterizing an electrode structure of the present invention.

First Embodiment

FIG. 1 is a longitudinal sectional view schematically showing the basic configuration of a gas discharge device according to the present invention as a first embodiment. An elongate glass tube 1 filled with a gaseous mixture of neon and xenon constitutes an envelope that is a main component of the device. A pair of long electrodes 2 and 3 extending along the longitudinal direction of the glass tube 1 is arranged to extend to either side with a gap 4 therebetween on the outer surface of the bottom part which is the back side of the glass tube 1. The long electrode 2 is grounded, while the other long electrode 3 is supplied with a sine wave alternating-current voltage from a sine wave alternating-current power source AC.

The glass tube 1 serving as the envelope is formed such that a pipe-like preform of a borosilicate glass including silicon oxide ($SiO_2$) and boron oxide ($B_2O_3$) as main components is redrawn to be formed into a thin tube with an outer diameter of 5 mm or less and a thickness of 500 μm or less.

The transverse section of the glass tube 1 may be circular, flat-oval, rectangular, or trapezoidal as shown in FIG. 2(*a*), (*b*), (*c*), or (d). In the case where a gas discharge device for an ultraviolet light source is configured by forming an ultraviolet light-emitting phosphor layer on the inner surface of the glass tube 1 as described later, it is important from the viewpoint of ultraviolet transmittance that the glass tube 1 has a thickness of 300 μm or less at the front side serving as a light-emitting surface. The glass tube 1 shown in FIG. 1 according to the embodiment has a rectangular transverse section shown in FIG. 2(*c*) in which the front side and the back side facing each other across a major axis have a flat surface.

Even if the borosilicate glass is used, the transmittance of 90% or more can be obtained with respect to ultraviolet light with a wavelength band of UV-B by setting its thickness to 300 μm or less. In this case, the thickness at the back side of the glass tube 1 where electrodes are disposed may be set larger than the thickness at the front side to enhance mechanical strength as in the example of the transverse section illustrated in FIG. 2(*b*), (*c*), or (d). The glass tube 1 in which the thicknesses of the surfaces facing each other are asymmetric can be implemented by a process control for shaping the glass preform.

In the configuration shown in FIG. 1, adjacent proximal ends of a pair of the long electrodes 2 and 3 constitute trigger electrode portions 2*a* and 3*a*, and a gas space corresponding to the gap 4 with a gap size Dg becomes a trigger discharge portion 5 in the glass tube 1. Further, extension portions extending to either side from the trigger electrode portions 2*a* and 3*a* in the direction of being away from each other constitute main electrode portions 2*b* and 3*b*, each having a length EL, and a gas space corresponding to the main electrode portions 2*b* and 3*b* becomes a main gas discharge portion 6. The trigger electrode portion and the main electrode portion are names given to the portions for the sake of convenience, and the substantial electrode pattern is very simple such that a pair of elongate electrodes are disposed in the axial direction of the tube with the gap 4 interposed between adjacent ends of the electrodes.

The long electrodes 2 and 3 may be directly formed on the outer surface of the glass tube 1 by printing a silver paste or the like, or may be formed by pasting a metal foil such as a copper foil or an aluminum foil or a metal mesh pattern formed on a base film made of a resin onto the outer surface of the glass tube 1. Alternatively, the pair of long electrodes 2 and 3 may be formed on the outer surface of the glass tube through an insulating layer or an insulating film.

In FIG. 1, the long electrodes 2 and 3 are disposed in a straight line along the longitudinal direction of the outer surface at the bottom of the glass tube 1. However, the pair of long electrodes 2 and 3 may be disposed on the side surface or the top surface of the glass tube 1.

Further, the angular positions of the pair of the long electrodes 2 and 3 relative to the tube axis may differ on the side face of the glass tube 1. In the case where the pair of long electrodes 2 and 3 is formed on the light-emitting surface of the glass tube 1, a known transparent electrode such as ITO or a metal electrode with a mesh pattern has to be used for allowing the long electrodes 2 and 3 to transmit the emission light. However, in an ultraviolet light-emitting tube using an ultraviolet phosphor, the electrodes are preferably disposed on the back side except the light-emitting surface in order to prevent emission loss.

FIG. 3 is a schematic diagram for describing a discharge model of the gas discharge device shown in FIG. 1. As shown in FIG. 3(*b*), an alternating-current voltage with a sine wave shown in FIG. 3(*a*) is applied between a pair of long electrodes 2 and 3 in the state in which the long electrode 2 is grounded, while the long electrode 3 is connected to the sine wave alternating-current power source AC.

When a voltage v1 in the increasing process of the sine wave voltage exceeds a discharge start voltage Vf between the trigger electrode portions 2*a* and 3*a* at a timing t1, discharge occurs in the trigger discharge portion 5. Due to this trigger discharge, a lot of space charges are supplied to the adjacent gas space, so that a sort-of pilot fire effect occurs, and thus, the discharge extends toward the main electrode portions 2*b* and 3*b* of the long electrodes with the increase in the sine wave voltage and grows to so-called long-distance discharge.

Simultaneously, charges (electrons (−) and plus ions (+)) having a polarity opposite to the polarity of the applied voltage are accumulated as wall charges on an inner wall surface of the glass tube 1 corresponding to the trigger electrode portions 2*a* and 3*a* that initially generate the trigger discharge, and the electric field caused by this wall charges cancels the electric field caused by the applied voltage. Thus, the discharge in the trigger discharge portion 5 is stopped.

FIGS. 3(*b*), (*c*), (*d*), and (*e*) schematically show the discharge and the accumulation state of the wall charges corresponding to timings t1 to t4 of the applied sine wave voltage, and FIGS. 3(*f*), (*g*), (*h*), and (*i*) schematically show the discharge and the accumulation state of the wall charges corresponding to timings t5 to t8 after the polarity inversion.

It can be understood from this model that the discharge generated in the trigger discharge portion 5 between the trigger electrode portions 2*a* and 3*a* at the timing t1 is extended to the main discharge portion 6 along the extending direction of the main electrode portions 2*b* and 3*b* at the timings t2 and t3 during the increasing process of the applied voltage, accompanied by the accumulation of the wall charges.

At the timing t4 during the voltage dropping process after the applied sine wave voltage reaches one of the crest values, the wall charges are in the accumulation state shown in FIG. 3(*e*) and the discharge is stopped. Thereafter, at the timing t5 at which the polarity of the applied voltage is inverted, the electric field by the accumulated wall charges is added to the electric field in the increasing process of the applied sine wave voltage with the opposite polarity, resulting in that the effective voltage applied to the trigger discharge portion 5 between the trigger electrode portions 2*a* and 3*a* exceeds the discharge start voltage Vf, and thus, the trigger discharge is again generated as illustrated in FIG. 3(*f*). At the timings t6 and t7, the discharge is extended to the main discharge portion 6, accompanied by the generation of wall charges having opposite polarity, as shown in FIGS. 3(*g*) and (*h*) respectively. Then, at the timing t8 at which the discharge is extended to the end of the glass tube 1, the wall charges are in the accumulation state shown in FIG. 3(*i*), and the discharge is stopped. The operation described above is repeated.

To cause combined discharge by utilizing the increasing process of the applied voltage, a voltage with a saw-tooth waveform (ramp waveform) can be used instead of the sine wave voltage described above. Further, since the discharge tube having the external electrode configuration according to the present invention becomes a capacitive load, the combined discharge can be generated by utilizing the inclination at a rise time, even if a voltage with a rectangular waveform is used. Therefore, if an alternating-current voltage having a rise time is applied between the pair of long electrodes, the similar drive can be performed. However, it is desirable to use a sine wave voltage from the viewpoint of easiness in generating a waveform. A brightness can be adjusted by changing the frequency of the sine wave voltage or the inclination angle of the saw-tooth waveform voltage.

The combined discharge described above is alternately repeated between the pair of long electrodes 2 and 3 with the application of a sine wave voltage, and at each time, cathode glow emission and positive column emission are generated along the discharge path. In the case where a gas formed by mixing a small percent of xenon (Xe) into neon (Ne) is used as a discharge gas, emission of neon orange light and vacuum ultraviolet (VUV) with a wavelength of 143 nm and 173 nm are obtained as discharge light. Therefore, if the mixture ratio of Ne and Xe is appropriately adjusted and the emission of the gas discharge is used as it is, a neon orange light-emitting tube or an ultraviolet light-emitting tube can be obtained.

In the gas discharge device according to the first embodiment shown in FIG. 1, the glass tube 1 is formed to have a diameter of 5 mm to 0.5 mm and has a rectangular or a flat-oval shape in which a major axis on a transverse section is 2 mm, for example. The gap size Dg of the gap 4 between the proximal ends of the pair of long electrodes 2 and 3, i.e., the gap 4 between the trigger electrode portions 2*a* and 3*a*, is a factor for determining the start voltage of the trigger discharge. It is practically 5 mm or less, and can be set as 3 mm, for example. The discharge start voltage Vf of the trigger discharge portion 5 in this case is about 900 V.

On the other hand, the spread of the discharge in the extending direction of each of the long electrodes 2 and 3 varies according to the peak voltage Vp of the sine wave voltage to be applied. When the peak voltage Vp is set too high, there is a danger that the trigger discharge portion 5 is damaged. Specifically, while the size Dg of the gap between the trigger electrode portions is generally set within the range from about 0.1 mm to about 2 cm inclusive, the peak voltage Vp of the sine wave differs according to the effective length (2 EL+Dg) of the thin glass tube 1. Therefore, from the relationship between both factors, the length EL of each of the main electrode portions 2*b* and 3*b* of the long electrodes can be set to be more than three times, preferably about ten time, as large as the gap size Dg between the trigger electrode portions 2*a* and 3*a*. If the total discharge effective length of the thin glass tube 1 is 50 mm, the gap size Dg between the trigger electrode portions can be set as 3 mm, and the length EL (FIG. 1) of each of the main electrode portions can be set as 23.5 mm.

Consequently, the glass tube 1 using the pair of long electrodes 2 and 3 shown in FIG. 1 has a length of about 5 to 10 cm in total. If plural sets of the long electrodes 2 and 3 are alternately disposed with the trigger discharge gap 4 being interposed therebetween in the longitudinal direction as described later, a longer gas discharge device can be configured.

The frequency of the sine wave voltage is set to several 10 kHz, e.g., to 40 kHz, from the relationship between the capacitance between electrodes and impedance. The peak voltage Vp is set to be higher than the discharge start voltage Vf of the trigger discharge portion 5, that is, 1000 V or higher, according to the discharge start voltage Vf. However, the upper limit is preferably determined in consideration of the length of the spread of the discharge on the long electrode and the prevention of damage on the trigger discharge portion 5.

Further, since the gas discharge device according to the present invention employs a discharge system in which discharge is extended along the long electrode while being stopped by utilizing the accumulation of wall charges, a peak current while the device is driven can be suppressed, and thus, power consumption to be required is significantly low, compared to an LED or an excimer discharge lamp.

For reference, a commercially available 5 W compact power source circuit (for example, HIU-465 manufactured by Harison Electric Co., Ltd.) including an inverter circuit that converts 10 V DC voltage (battery) into a sine wave voltage of 42 kHz and a compact transformer that raises the sine wave voltage to a peak voltage of 1000 V can be suitably used for driving the gas discharge device according to the first embodiment.

Second Embodiment

Figure 4A:
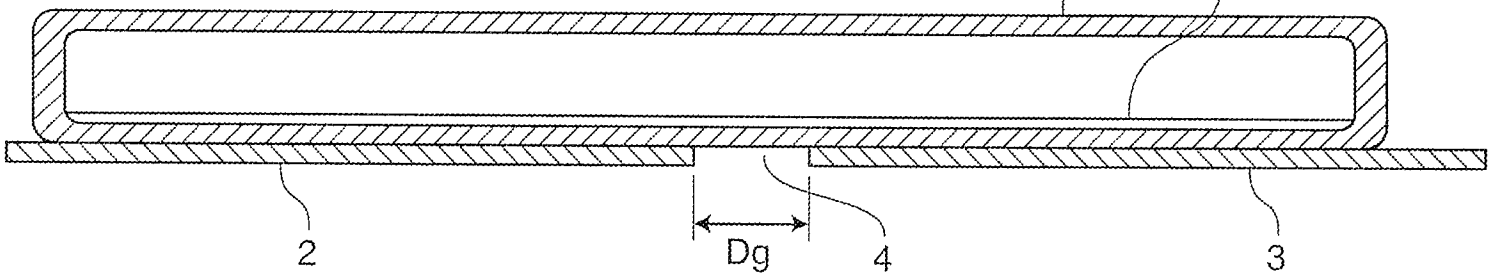
FIG. 4 shows a longitudinal sectional view and a transverse sectional view schematically showing a second embodiment of the present invention.
Figure 4B:
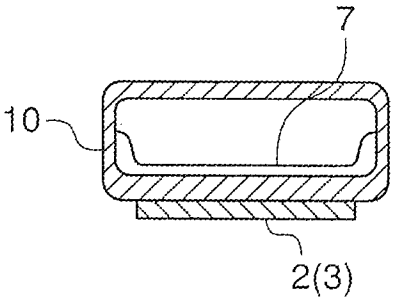

FIGS. 4(*a*) and (*b*) are each a longitudinal sectional view and a transverse sectional view of a gas discharge device according to a second embodiment of the present invention. The basic configuration of the second embodiment is substantially the same as that of the first embodiment, except that the second embodiment uses a gas discharge tube 10 including a phosphor layer 7, which emits light by being excited with ultraviolet light generated with gas discharge, on the inner surface of the bottom part at the back side of the glass tube 1 in FIG. 1. Notably, the transverse section of the glass tube 1 is rectangular, that is, flat quadrilateral, as shown in FIG. 4(*b*), and the glass tube 1 has flat surfaces facing each other across the major axis. There is nothing to hinder the radiation path of light except a thin tube wall with a thickness of 300 μm or less on the flat surface, serving as a light-emitting surface, at the front side of the gas discharge tube 10.

In the case where a gadolinium-activated phosphor ($LaMgAl_{11}O_{19}$:Gd) is used as one example of the phosphor layer 7, emission of ultraviolet light with 311 nm which is the wavelength range of UV-B band can be obtained. If a praseodymium-activated phosphor ($YBO_3$:Pr or $Y_2SiO_5$:Pr) is used, emission of ultraviolet light with 261 nm or 270 nm which is the wavelength range of UV-C band can be obtained.

A known precipitation method can be used to form the phosphor layer 7 of the gas discharge tube 10. Specifically, phosphor slurry in which particles of the above-mentioned phosphor are made into a suspension state is injected into the glass tube, and the glass tube is left to stand. Then, the supernatant liquid is exhausted and the precipitates are burned, whereby the phosphor layer 7 can be formed.

If fine crystal particles of magnesium oxide (MgO) are mixed during the preparation of a suspension of an ultraviolet light-emitting phosphor material, the effect of increasing the emission of secondary electrons from the phosphor layer 7 during the discharge operation can be obtained, which contributes to the reduction in discharge voltage. In the case where a small amount of visible phosphor, such as a red phosphor, is mixed in the ultraviolet light-emitting phosphor layer 7, emission of invisible ultraviolet spectrum can be confirmed by the emission of visible red light.

In the gas discharge device according to the second embodiment using the gadolinium-activated phosphor as the ultraviolet light-emitting phosphor layer 7, the combined discharge of the trigger discharge and the long-distance discharge along the long electrodes is repeated as in the first embodiment through the application of a sine wave voltage between the pair of long electrodes 2 and 3. Consequently, the ultraviolet emission having a peak at the wavelength of 311 nm could be obtained from the phosphor layer 7 with the emission intensity of 10 mW/cm$^2$ and luminous efficiency of 4% W/W.

Third Embodiment

Figure 5A:
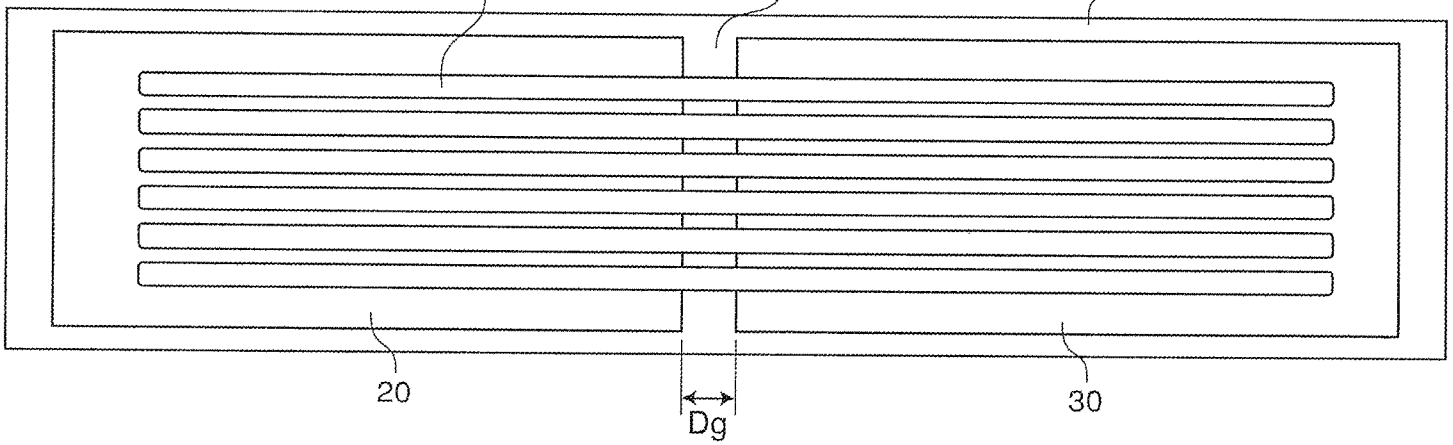
FIG. 5 shows a plan view and a transverse sectional view schematically showing the configuration of a flat light source according to a third embodiment of the present invention.
Figure 5B:
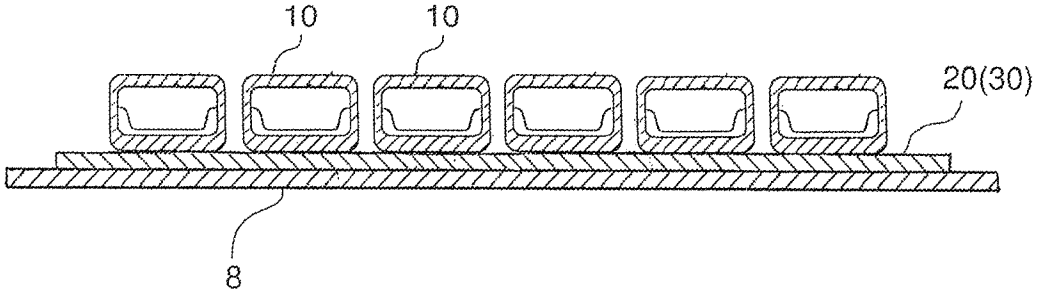

FIGS. 5(*a*) and (*b*) are each a plan view and a transverse sectional view showing the configuration of a flat surface light source according to a third embodiment of the present invention.

An electrode sheet 20 and an electrode sheet 30 are disposed close to each other with a gap 40 (gap size Dg) constituting a trigger discharge portion interposed therebetween, and six gas discharge tubes 10 having a rectangular or flat-oval transverse section and used in the second embodiment are disposed in parallel on the upper surface of the sheets as one example.

Specifically, the gas discharge tubes 10 for ultraviolet light emission shown in FIG. 4 are arrayed on the electrode sheets 20 and 30, which commonly serve as the long electrodes 2 and the long electrodes 3 respectively, to form a flexible flat light source. The back side flat surfaces of the discharge tubes 10 well fit the surfaces of the electrode sheets 20 and 30.

The electrode sheets 20 and 30 are formed by pasting an aluminum foil on a common support body 8 composed of a resin film such as a polyimide resin or PET. Further, the pair of electrodes 20, 30 can be formed by patterning the copper foil on the common support body 8. The pair of electrode patterns may be formed as a linear divided pattern corresponding to the individual discharge tube 10, and the divided pair of electrode patterns may be connected respectively in common at both end sides.

If fifty discharge tubes 10 with a length of 100 mm are arrayed on the electrode sheets 20 and 30, each tube having a transverse section with a major axis of 2 mm in the transverse direction, a 10×10 cm ultraviolet flat light source can be obtained. This flat light source has a very simple configuration, and emits light by utilizing long-distance discharge, thereby being capable of providing extremely high luminous efficiency and brightness (emission intensity). This configuration also provides a merit in which the electrode sheets 20 and 30 implement a function of a reflection plate by automatically covering almost all effective discharge area at the back side.

Further, when the 10×10 cm flat light source configured as described above is specified as a unit light source, and a plurality of the unit light sources are arrayed adjacent to each other in the horizontal direction and vertical direction in a mosaic pattern or in a tile pattern, a large-area ultraviolet irradiation device can be implemented.

In this case, if the electrode terminal of each of the unit light sources arrayed in the mosaic pattern is individually extracted and selectively connected to a drive source, an irradiation area is selectable in a unit of a small-area light source, and this is particularly effective for a medical application or the like. In this case as well, a compact power source that is the same as described above and converts a DC voltage into a sine wave and raises the resultant voltage can be used as the drive source, whereby a very simple and inexpensive unit light source configuration can be implemented as a whole. That is, the compact drive source circuit can easily be mounted on the back side of the support body 8 of the electrode sheet 30 to which a sine wave voltage is applied for each unit light source, and with this, the flat surface light source can be formed into a module.

Fourth Embodiment

Figure 6A:
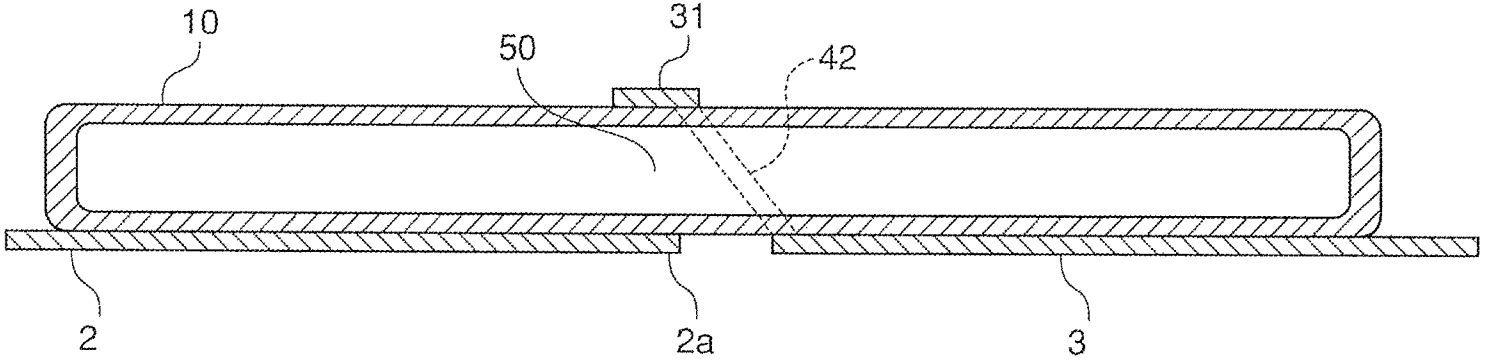
FIG. 6 shows a longitudinal sectional view and a plan view of a gas discharge device according to a fourth embodiment of the present invention.
Figure 6B:
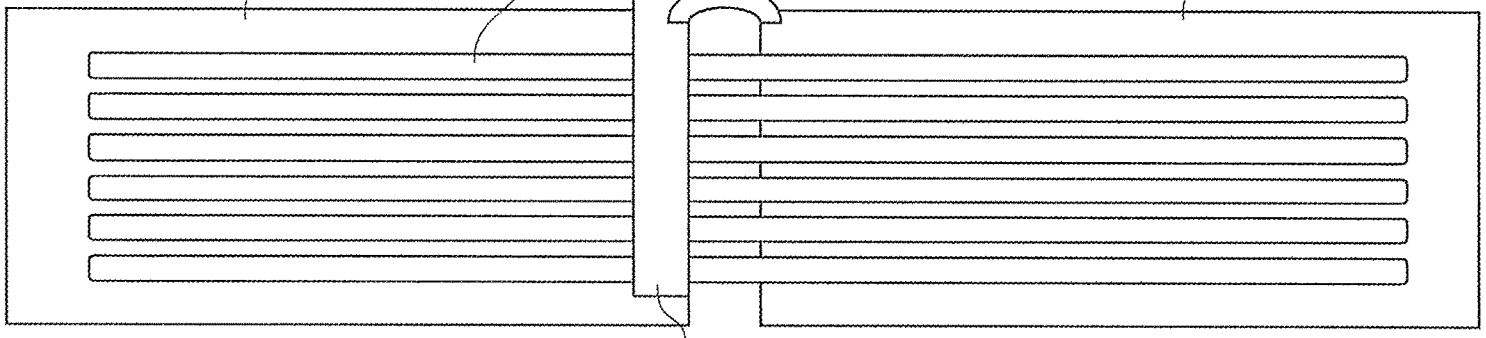

A fourth embodiment of the gas discharge device according to the present invention is shown in FIGS. 6(*a*) and (*b*). The present embodiment is characterized by the configuration of a trigger discharge portion 50. The other configuration is similar to that in the third embodiment (FIG. 5). It is to be noted that the ultraviolet light-emitting phosphor layer 7 provided on the inner surface of the gas discharge tube 10 is not shown in FIGS. 6(*a*) and (*b*).

Specifically, in the longitudinal sectional view in FIG. 6(*a*), a trigger electrode member 31 is formed on an upper opposing surface facing the trigger electrode portion 2*a* of the long electrode 2 extending to the left in the figure. Further, this trigger electrode member 31 is connected to the other long electrode 3 extending to the right by a connection conductor 42. According to this configuration, the trigger discharge portion 50 having an opposed discharge cell structure intersecting the gas discharge tube 10 is created.

In the case where multiple, e.g., six gas discharge tubes 10 are arrayed to form a flat light source, the flat light source has the configuration shown in FIG. 6(*b*). The electrode sheets 20 and 30 are substantially the same as those in the third embodiment described previously with reference to FIG. 5(*a*).

In this configuration, a common trigger electrode member 31*a* intersecting the tubes is provided to face the right end of the left electrode sheet 20 on the upper surface of the array of the gas discharge tubes, and this trigger electrode member 31*a* is connected to the right electrode sheet 30 with a connection conductor 42*a*.

The trigger electrode member 31*a* may be a transparent conductive film, or may be formed by applying a silver paste in a stripe pattern. Alternatively, a conductive film having a trigger electrode pattern may be formed in advance on a surface of an ultraviolet transmission acrylic resin film (for example, Kanaselite #001), and the resultant may be laminated on the upper surface of the array of the gas discharge tubes so as to also function as a protection film.

In the fourth embodiment in which the trigger discharge portion 50 has an opposed discharge cell structure, the initial trigger discharge start voltage is lower than that in the surface discharge cell structure along the longitudinal direction of the glass tube 1 as in the first or the second embodiment, whereby the trigger discharge can reliably be generated.

The operation in which the trigger discharge of the opposed discharge system becomes a supply source of space electrons to the adjacent gas discharge spaces as a pilot fire and the long-distance discharge accompanied by the wall charges is gradually extended in the tube axis direction with the increase in the sine wave voltage is the same as the operation described in the first embodiment. The trigger electrode member 31 located on the upper surface and the right electrode sheet 30 connected thereto are connected to a ground potential, and a sine wave drive voltage is applied to the left electrode sheet 20 for driving.

It is to be noted that the trigger electrode member 31*a* is not necessarily provided on the position facing the trigger electrode portion 2*a* at the end of one of the long electrodes as illustrated in FIG. 6(*a*). For example, the trigger electrode member 31*a* may be formed as a linear conductive member that extends on the side face of the gas discharge tube 10 so as to obliquely approach from the end of the electrode sheet 30 to the end of the other electrode sheet 20 provided on the bottom surface of the gas discharge tube 10. Alternatively, the trigger electrode member may extend from the proximal end of one of the main electrode portions toward the other proximal end.

It is only sufficient to use a commercially available compact power source circuit (for example, S-05584 manufactured by Elevam Corporation) including an inverter circuit that coverts a DC voltage (battery) of 5 V into a sine wave voltage of 80 kHz and a compact transformer that raises the sine wave voltage to the peak voltage of 650 V, in order to drive a gas discharge device of a size of 3×3 cm (9 $cm^2$) formed by arranging, with a space of 1 mm, ten tubes with a major axis of 2 mm and a length of 3 cm having the structure provided with the trigger electrode member 31*a* as in the fourth embodiment.

Specifically, with the structure provided with the trigger electrode member 31*a*, ultraviolet light emission intensity of 6 $mW/cm^2$ and efficient of 4% W/W could be implemented with further reduced power consumption. Since the effective discharge area of this gas discharge device was 9 $cm^2$, an ultraviolet light-emitting device with an output intensity exceeding 50 mW in total could be implemented.

Fifth Embodiment

Figure 7A:
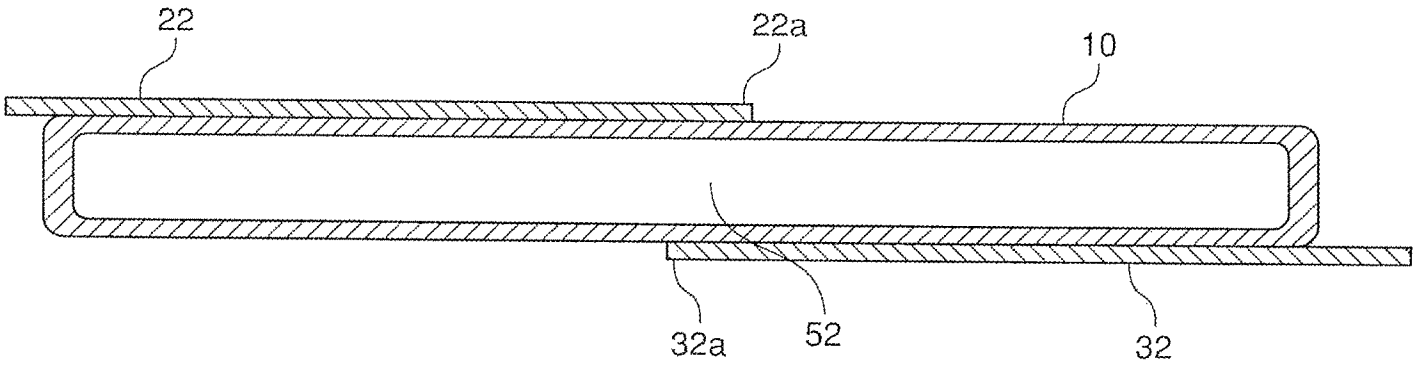
FIG. 7 shows a longitudinal sectional view of a gas discharge device according to a fifth embodiment of the present invention and a schematic plan view showing the configuration of a flat light source using the gas discharge device.
Figure 7B:
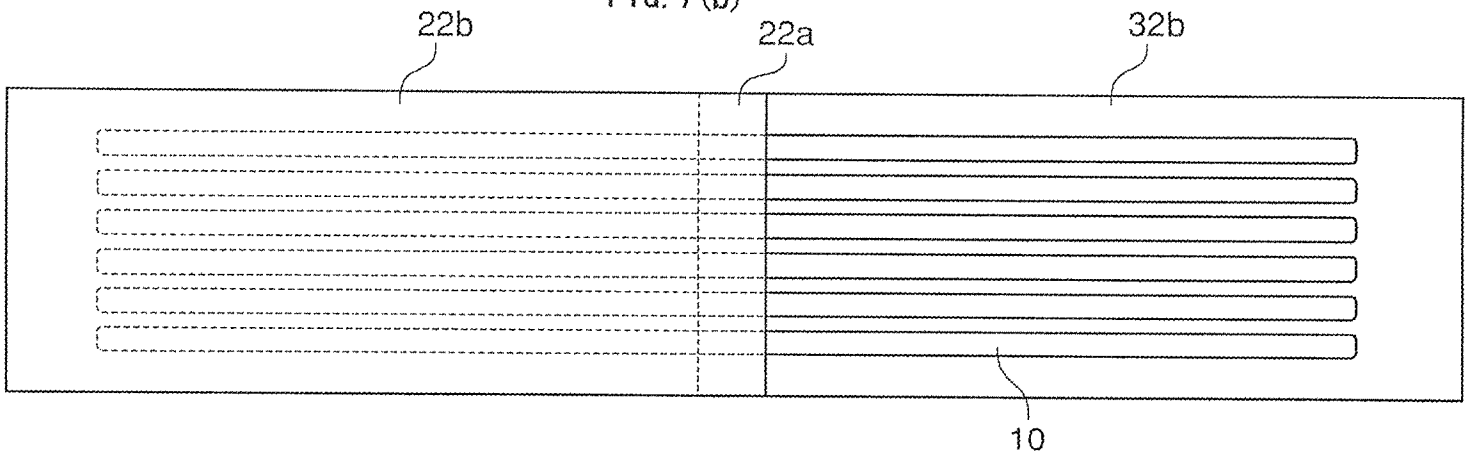

FIG. 7(*a*) is a longitudinal sectional view showing a gas discharge device according to a fifth embodiment of the present invention, and FIG. 7(*b*) is a plan view thereof. The feature of the gas discharge device according to this embodiment is such that long electrodes 22 and 32, which make a pair, are provided on the surfaces, which vertically face each other, on a single gas discharge tube 10, and their proximal ends are overlapped to constitute a trigger discharge portion 52 with an opposite discharge cell structure. The ultraviolet light-emitting phosphor layer 7 on the inner surface of the gas discharge tube 10 is not shown.

Specifically, a long electrode 22 extending from a left end to the center is provided on the upper outer surface of the gas discharge tube 10 containing a discharge gas filled therein, and a long electrode 32 extending from a right end to the center is provided on the lower outer surface. The both long electrodes have an overlapped portion serving as trigger electrode portions 22*a* and 32*a* at the center, and a trigger discharge portion 52 is formed in the gas space corresponding to the overlapped portion.

In the case where a plurality of gas discharge tubes 10 is arrayed to form a flat light source, a tube array including a plurality of (here, six) tubes is vertically sandwiched between an electrode sheet 22*b* and an electrode sheet 23 which commonly serve as the long electrodes 22 and the long electrodes 23 of the respective tubes. The upper electrode sheet 22*b* serving as a light-emitting surface has to be formed from a transparent conductive film or a metal mesh pattern in consideration of extracting radiation light. This configuration causes a transmission loss of light by one electrode, so that it is rather suitable for a visible flat light source than for an ultraviolet flat surface light source.

It is preferable that the electrode sheet 22*b* and the electrode sheet 32*b* may preliminarily be formed on a common support film in a solid pattern or a stripe pattern following the array of the gas discharge tubes.

Since the trigger discharge portion 52 has an opposite discharge system in the configuration of the fifth embodiment, initial trigger discharge can reliably be generated with a lower voltage. Further, the connection to the drive source is set such that the electrode sheet 22*b* located on the light-emitting surface has a ground potential and a sine wave alternating-current voltage is applied to the electrode sheet 32*b* at the back surface side.

In this case as well, the gas discharge device can be driven by a compact power source circuit (S-05584 manufactured by Elevam Corporation) as in the fourth embodiment.

Sixth Embodiment

Figure 8A:
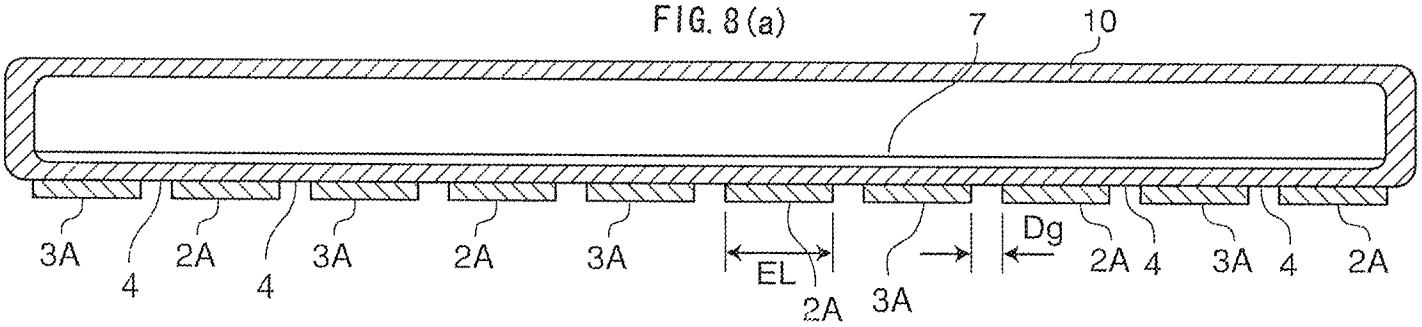
FIG. 8 shows a sectional view of a gas discharge device according to a sixth embodiment of the present invention and a back view showing the configuration of a flat surface light source using the gas discharge device viewed from the back side.
Figure 8B:
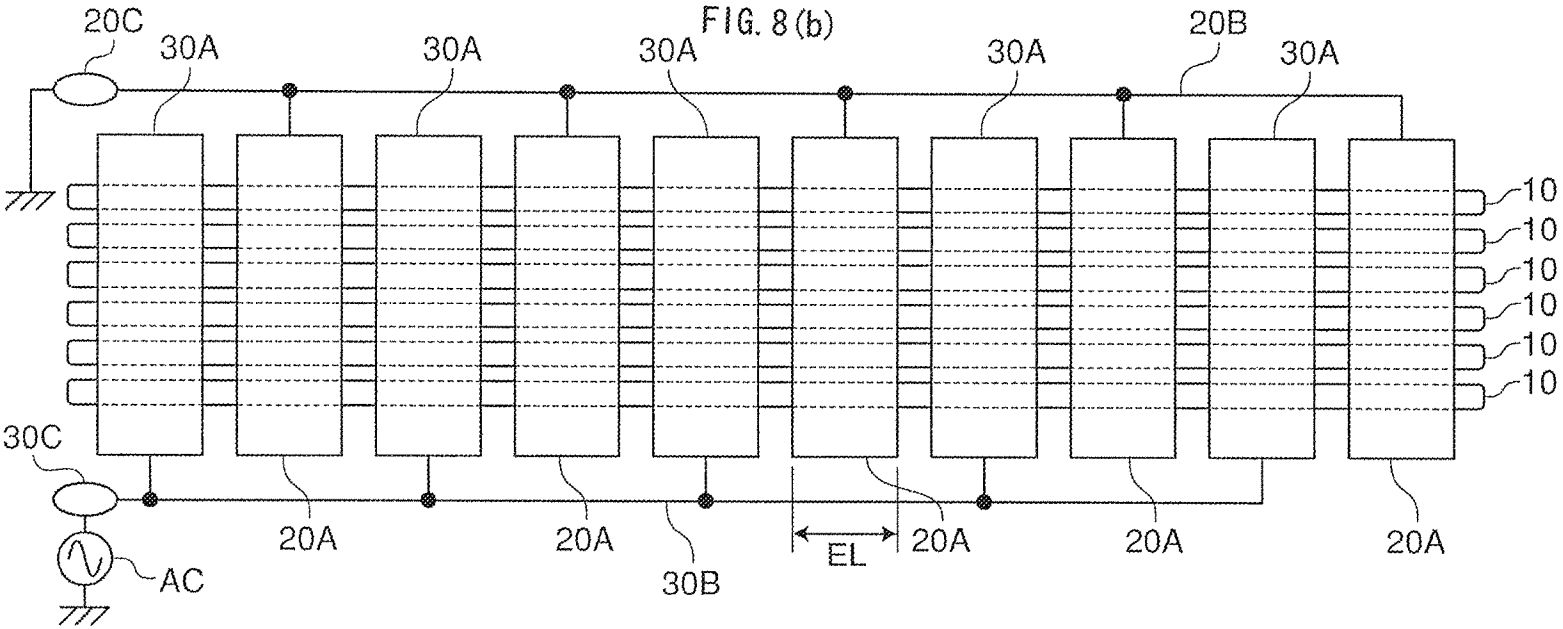

FIGS. 8(*a*) and (*b*) are each a longitudinal sectional view of a gas discharge device for a light source according to a sixth embodiment of the present invention and a back view of a flat light source using the gas discharge device. The sixth embodiment is characterized in that multiple pairs of electrode segments 2A and 3A corresponding to the long electrodes 2 and 3 in FIG. 4 are alternately arranged in a line to increase the length of the gas discharge tube.

Specifically, as illustrated in FIG. 8(*a*), the long electrode 2 and the long electrode 3 in FIG. 4 are formed as multiple electrode segments 2A and 3A, and they are alternately provided on the bottom surface at the back side of a single gas discharge tube 10 with the gap 4 (size Dg) between the trigger electrodes interposed between the adjacent electrode segments. The length EL of each of the electrode segments 2A and 3A is at least three times as large as the gap size Dg between the trigger electrodes as described in the first embodiment.

Therefore, the gas discharge device according to the present invention generates combined discharge which is of a different system from discharge conventionally generated between display electrode pairs composing a pixel in a plasma tube array for a large-sized display. The difference in the discharge system is caused by the length of an electrode and a long increasing process of the sine wave drive voltage.

FIG. 8(*b*) is a back view when a flat light source configured by arraying a plurality of gas discharge tubes 10 is viewed from the back side in the sixth embodiment. In the flat surface light source, the electrode segment 2A and the electrode segment 3A formed from an aluminum foil or the like shown in FIG. 8(*a*) are alternately arrayed on an unillustrated support film formed from Kapton (registered trademark) or PET as common segment electrodes 20A and 30A intersecting the gas discharge tubes 10. Further, the common segment electrodes 20A and 30A are respectively connected in common to connection conductors 20B and 30B as a first group and a second group, and led to terminal portions 20C and 30C. In this case, the common segment electrodes 20A and 30A can be configured such that the electrode segments 2A and 3A provided individually on each discharge tube are respectively connected in common by a wiring conductor on an unillustrated support substrate.

Thus, when the terminal 20C is connected to a ground potential and a sine wave alternating-current voltage from a power source AC is applied from the other terminal 30C, trigger discharge in the gap between the adjacent electrode segments and long-distance discharge along each electrode segment are repeatedly generated in each discharge tube, whereby ultraviolet light emission throughout the entire surface can be obtained.

Modifications of Embodiments

The electrode segments in the sixth embodiment are not necessarily arrayed on a straight line on the bottom surface of the gas discharge tube 10 as shown in FIG. 8(*a*). As a modification, the electrode segments can be alternately provided on the upper surface and the lower surface of the gas discharge tube 10 in such a manner that the adjacent ends of the electrode segments are overlapped with each other. This configuration can provide a gas discharge device having a plurality of trigger discharge portions of an opposite electrode structure along the longitudinal direction of the glass discharge tube as in the fifth embodiment described with reference to FIG. 7.

Alternatively, in the configuration in FIG. 8(*a*), the trigger electrode member 31, which has been described above as the feature of the fourth embodiment, may be provided to one of the pair of electrode segments. This configuration can reliably generate trigger discharges in the trigger discharge portions of an opposite discharge system implemented by the trigger electrode members throughout the entire length of the gas discharge tube, even if the length of the gas discharge tube is increased.

In the embodiments described above, a long and thin glass tube is used as the envelope containing a discharge gas sealed therein. However, it can be configured such that a closed discharge space is formed between two thin glass sheets, and strip electrodes extending in the longitudinal direction are provided on the outer surface with a trigger discharge gap being interposed therebetween. When a plurality of pairs of strip electrodes is arranged in parallel on the outside of the common discharge space, a flat surface light source substantially similar to the flat light source in the third embodiment can be obtained.

The above-mentioned embodiments describe the configuration in which long electrodes that make a pair are directly provided on the outer surface of a thin glass tube. However, an electrode pair may be provided through an insulating layer or an insulating film in consideration of compensation of smoothness of the glass tube wall or protection of the tube wall. In the case where a long electrode with a solid pattern formed from an aluminum foil is directly bonded to the outer surface of a thin glass tube, air bubbles are present on the bonded surface due to fine irregularities on the glass surface, and this might cause an unnecessary spark discharge while the device is driven. In order to prevent this problem, the electrodes are preferably provided through a thin polyimide insulating tape, e.g., Kapton (registered trademark). Specifically, a configuration in which the common electrodes 20 and 30 are disposed at the back of the electrode support sheet 8 in FIG. 6(*b*) and a thin insulating film is formed between the thin glass tube and the electrodes may be employed.

In addition, in order to protect the surface of a thin glass tube, a heat-resistant fluoroplastic having an ultraviolet light transmission function, such as Teflon (registered trademark), may be coated on the surface of the thin tube. According to this configuration, resistance to weather and resistance to impact of the thin glass tube are enhanced, whereby practical application can be expanded. In this case as well, the electrode pair on the outer surface of the glass tube is indirectly provided on the surface of the glass tube through an insulating layer of a coating resin.

EXPLANATION OF NUMERALS

1 glass tube
2, 3 long electrode
2A, 3A electrode segment
2*a*, 3*a* trigger electrode portion
2*b*, 3*b* main electrode portion
4 gap
5 trigger discharge portion
6 main gas discharge portion
7 phosphor layer
8 support body
10 gas discharge tube
20, 30 electrode sheet
20A common segment electrode
20B connection conductor
20C terminal portion
22, 32 electrode sheet
22*a* trigger electrode portion
30A common segment electrode
30B connection conductor
30C terminal portion
31 trigger electrode member
32*a* trigger electrode portion
40 gap
42 connection conductor
50 trigger discharge portion
52 trigger discharge portion
AC sine wave alternating-current power source

The invention claimed is:

1. A gas discharge device for ultraviolet light emission comprising: a transparent thin tube filled with a discharge gas and having a front side and a back side flat surface facing each other on a transverse section thereof; and first and second electrodes provided outside of the transparent thin tube along a longitudinal direction at the back side flat surface, each of said first and second electrodes including: trigger electrode portions constituting a trigger discharge portion interposed between adjacent ends of them; and main electrode portions extending in a direction of being away each other from the trigger discharge portion, wherein the transparent thin tube comprises a borosilicate glass having a thickness of 300 μm or less at the front side serving as a light-emitting surface, and further comprising an ultraviolet light-emitting phosphor layer provided on an inside at the back side flat surface of the transparent thin tube.

2. The gas discharge device for ultraviolet light emission according to claim 1, wherein the transparent thin tube has a flat-oval cross-section with a major axis of 5 mm or less, the front side having a flat surface, and the front and back side flat surfaces facing each other across the major axis on the transverse section.

3. The gas discharge device for ultraviolet light emission according to claim 1, wherein the first and second electrodes extend in a direction toward either end along a longitudinal direction of the transparent thin tube, with a gap corresponding to the trigger discharge portion having a size within a range of 0.1 mm to 2 cm interposed therebetween, with a length at least three times as large as the size of the gap, wherein proximal ends of the first and second electrodes at the gap constitute the trigger electrode portions, and extension portions at either side constitute the main portions.

4. The gas discharge device for ultraviolet light emission according to claim 1, wherein a pair of the first and second electrodes are provided on a straight line along a longitudinal direction of the transparent thin tube with a pattern covering a substantially whole effective discharge area except a gap corresponding to the trigger discharge portion at the back side flat surface.

5. The gas discharge device for ultraviolet light emission according to claim 4, wherein plural pairs of the first and second electrodes are alternately provided along the longitudinal direction of the transparent glass thin tube.

6. The gas discharge device for ultraviolet light emission according to claim 1, further comprising a trigger electrode member connected to the proximal end of one of the first and second electrodes and faces the proximal end of the other.

7. The gas discharge device for ultraviolet light emission according to claim 1, wherein a visible phosphor is mixed in the ultraviolet light-emitting phosphor.

8. A gas discharge device for ultraviolet light emission including a plurality of gas discharge tubes arranged in parallel, each of the gas discharge tubes serving as a unit light-emitting source comprising: a transparent thin glass tube filled with discharge gas and having a front side surface and a back side flat surface facing each other in a transverse section; and first and second electrodes provided outside of the back side flat surface, each of the first and second electrodes including: trigger electrode portions constituting a trigger discharge portion interposed between adjacent ends of them; and main electrode portions extend in a direction of being away each other from the trigger discharge portion along a longitudinal direction of the glass tube, wherein the first and second electrodes of the gas discharge tubes are respectively electrically connected in common, wherein the gas discharge tube comprises a borosilicate glass having a thickness of 300 μm or less at the front side surface serving as a light-emitting surface, and further comprises an ultraviolet light-emitting phosphor layer provided on an inside at the back side flat surface.

9. A flat light source for ultraviolet light emission comprising: a plurality of gas discharge tubes, each of the gas discharge tubes filled with discharge gas and having a front side flat surface and a back side flat surface facing each other on a transverse section thereof, and providing an ultraviolet light-emitting phosphor layer on an inner surface at the back side flat surface; and an insulating film commonly supporting the back side flat surfaces of the plurality of gas discharge tubes arranged in parallel, wherein the insulating film includes first and second electrode sheets commonly facing the back side flat surface of each discharge tube, the first and second electrode sheets having a common electrode pattern which includes: a pair of trigger electrode portions constituting a trigger discharge portion interposed between adjacent ends of them; and main electrode portions extending in a direction of being away each other from the trigger discharge portion along a longitudinal direction of the gas discharge tube, wherein the gas discharge tube comprises a borosilicate glass having a thickness of 300 μm or less at the front side surface serving as a light-emitting surface.

10. The flat light source for ultraviolet light emission according to claim 9, wherein the first and second electrode sheets are formed from a metal foil pasted on one surface of the insulating film.

11. A driving method of the gas discharge device according to claim 1, the method comprising: connecting an alternating-current power source between the first and second electrodes; and driving the gas discharge device such that discharge generated on the trigger electrode portions is extended to the main electrode portions in an increasing process of an applied voltage waveform.

12. The driving method of the gas discharge device according to claim 11, wherein one of the first and second electrodes is connected to a ground potential, and an alternating-current voltage by which discharge in the trigger discharge portion corresponding to the trigger electrode portions is started in an increasing process to a peak voltage is applied to the other electrode.

13. A flat light source for ultraviolet emission comprising:

a plurality of gas discharge tubes each of which is filled with discharge gas and having a front side and a back side flat surface facing each other on a transverse section thereof;

an ultraviolet light-emitting phosphor layer on an inner surface at the back side flat surface;

an insulating support commonly supporting the back side flat surfaces of said plurality of gas discharge tubes arranged in parallel;

and first and second electrodes commonly facing the back side flat surface of each gas discharge tube on the insulating support with a pattern extending to either side with a gap constituting a trigger discharge portion in each gas discharge tube, wherein the gas discharge tube comprises a borosilicate glass having a thickness of 300 μm or less at the front side serving as a light-emitting surface.

14. The flat light source for ultraviolet light emission according to claim 13, wherein a pair of the first and second electrodes has a sheet pattern arranged on the insulating support so as to cover a substantially whole effective discharge area except the gap at the back side flat surface of each gas discharge tube.

* * * * *